US006355913B1

(12) United States Patent
Authier et al.

(10) Patent No.: US 6,355,913 B1
(45) Date of Patent: Mar. 12, 2002

(54) INFRARED SENSOR FOR HOT TUB SPA HEATING ELEMENT

(75) Inventors: Michel Authier, St-Augustin; Benoit Laflamme, Quebec City, both of (CA)

(73) Assignee: Gecko Electronique, Inc., Quebec (CA)

( * ) Notice:
Subject to any disclaimer, the term of this patent is extended or adjusted under 35 U.S.C. 154(b) by 0 days.

(21) Appl. No.: 09/584,206

(22) Filed: May 31, 2000

(51) Int. Cl.[7] ..... H05B 1/02

(52) U.S. Cl. ..... 219/481; 219/497; 219/502; 4/541.2

(58) Field of Search ..... 219/481, 497, 219/501, 505, 502; 392/488, 491; 361/15, 12; 4/541.2, 541.1, 584, 545

(56) References Cited

U.S. PATENT DOCUMENTS 4,556,779 A * 12/1985 Hashimoto et al. ..... 219/216
5,212,763 A * 5/1993 Arold et al. ..... 392/488
5,585,025 A * 12/1996 Idland ..... 219/497
6,084,218 A * 7/2000 McDonough ..... 219/508

* cited by examiner

*Primary Examiner*—Mark Paschall
(74) *Attorney, Agent, or Firm*—John R. Ross; John R. Ross, III

(57) ABSTRACT

An overheating protection system for a spa and the spa's associated equipment. Elements include: a heating element for heating the spa's water, an infrared sensor for detecting the amount of infrared radiation emitted by the heating element, a heating element deactivation device electrically connected to the heating element and the infrared sensor, wherein the heating element deactivation device is for deactivating the heating element. In a preferred embodiment, the heating element deactivation device is an electric circuit comprising a comparator circuit and a control circuit.

12 Claims, 6 Drawing Sheets

1B
1
WATER PUMP
4
AIR BLOWER
J
J
J
J
J
J
J
D
D
D
SPA TUB
2
11
13
TS
112

KEYPAD
200
51A
COMP CKT
CTRL CKT
52A
PRIOR ART
17A
17B
7
SPA CONTROLLER (CPU)
TO WATER PUMPS
TO AIR BLOWER
111
53A
54
50
TS
71
S
5
70
WATER PUMP
S
WPS
1A
3
15

1B
WATER PUMP
1
4
AIR BLOWER
J
J
J
J
D
SPA TUB
2
13
11
J
J
D
J
TS
112
D
7
SPA CONTROLLER (CPU)
TO WATER PUMPS
TO AIR BLOWER
MICROPROCESSOR
17A
51A
COMP CKT
CTRL CKT
52A
17B
51B
COMP CKT
CTRL CKT
52B 53B
53A
54
50
TS
71
5
70
S
WATER PUMP
S
1A
18
3

INFRARED SENSOR FOR HOT TUB SPA HEATING ELEMENT

The present invention relates to spas, and, in particular, to overheating protection systems for spas.

BACKGROUND OF THE INVENTION

A spa (also commonly known as a "hot tub") is a therapeutic bath in which all or part of the body is exposed to forceful whirling currents of hot water. Typically, the spa's hot water is generated when water contacts a heating element in a water circulating heating pipe system. A major problem associated with the spa's water circulating heating pipe system is the risk of damage to the heater and adjacent parts of the spa when the heater becomes too hot.

FIG. 1 shows prior art hot tub spa 1. Spa controller 7 is programmed to control the spa's water pumps 1A and 1B and air blower 4. In normal operation, water is pumped by water pump 1A through heater 3 where it is heated by heating element 5. The heated water then leaves heater 3 and enters spa tub 2 through jets 11. Water leaves spa tub 2 through drains 13 and the cycle is repeated.

An overheating situation can occur if there is an insufficient flow of water passing heating element 5 in heater 3. An insufficient flow of water can occur as the result of a blockage in pipe 17A or a blockage in jets 11. When this occurs, heater 3 is full of water, however, the water quickly gets very hot because its flow into spa tub 2 has been impeded. As the water inside heater 3 continues to get hotter, a dangerous "hot pipe" condition may occur. A hot pipe condition may cause significant damage to heater 3 and adjacent piping.

Other conditions may cause little or no flow of water through the pipe containing heating element 5 during the heating process. These problems can cause what is known in the spa industry as a "dry fire". Dry fires occur when there is no water in heater 3 or when the flow of water is too weak to remove enough heat from the heating element 5. Common causes of low water flow are a dirty filter or a clogged pipe. For example, referring to FIG. 1, if a bathing suit became lodged in pipe 17B clogging the pipe, flow of water through heater 3 would be impeded and a dry fire could occur.

Known Safety Devices

FIG. 1 shows a prior art arrangement to prevent overheating conditions. A circuit incorporating temperature sensor 50 serves to protect spa 1 from overheating. Temperature sensor 50 is mounted to the outside of heater 3. Temperature sensor 50 is electrically connected to comparator circuit 51A and control circuit 52A, which is electrically connected to high limit relay 53A.

As shown in FIG. 1, power plug 54 connects heating element 5 to a suitable power source, such as a standard household electric circuit. Water inside heater 3 is heated by heating element 5. Due to thermal conductivity the outside of heater 3 becomes hotter as water inside heater 3 is heated by heating element 5 so that it is approximately equal to the temperature of the water inside heater 3. Temperature sensor 50 sends an electric signal to comparator circuit 51A corresponding to the temperature it senses. When an upper end limit temperature limit is reached, such as about 120 degrees Fahrenheit, positive voltage is removed from the high temperature limit relay 53A, and power to heating element 5 is interrupted.

A detailed view of comparator circuit 51A and control circuit 52A is shown in FIG. 4. Temperature sensor 50 provides a signal representing the temperature at the surface of heater 3 to one input terminal of comparator 60. The other input terminal of comparator 60 receives a reference signal adjusted to correspond with a selected high temperature limit for the surface of heater 3. As long as the actual temperature of the surface of heater 3 is less than the high temperature limit, comparator 60 produces a positive or higher output signal that is inverted by inverter 62 to a low or negative signal. The inverter output is coupled in parallel to the base of NPN transistor switch 64, and through a normally open high limit reset switch 66 to the base of a PNP transistor switch 68. The low signal input to NPN transistor switch 64 is insufficient to place that switch in an "on" state, such that electrical power is not coupled to a first coil 70 of a twin-coil latching relay 74. As a result, the switch arm 76 of the latching relay 74 couples a positive voltage to control circuit 52A output line 78 which maintains high limit relay 53A in a closed position (FIG. 1).

As shown in FIG. 4, in the event that the switch arm 76 of the latching relay 74 is not already in a position coupling the positive voltage to the output line 78, momentary depression of the high limit reset switch 66 couples the low signal to the base of PNP transistor switch 68, resulting in energization of a second coil 72 to draw the switch arm 76 to the normal power-on position.

If the water temperature increases to a level exceeding the preset upper limit, then the output of the comparator 60 is a negative signal which, after inversion by the inverter 62, becomes a high signal connected to the base of NPN transistor switch 64. This high signal switches NPN transistor switch 64 to an "on" state, and thus energizes the first coil 70 of latching relay 74 for purposes of moving the relay switch arm 76 to a power-off position. Thus, the positive voltage is removed from the high temperature limit relay 53A, and power to heating element 5 is interrupted. Subsequent depression of the high limit reset switch 66 for resumed system operation is effective to return switch arm 76 to the power-on position only if the temperature at the surface of heater 3 has fallen to a level below the upper limit setting.

In addition to the circuit incorporating temperature sensor 50, it is an Underwriters Laboratory (UL) requirement that there be a separate sensor located inside heater 3 in order to prevent dry fire conditions. There are currently two major types of sensors that are mounted inside of heater 3: water pressure sensors and water flow sensors.

Water Pressure Sensor

FIG. 1 shows water pressure sensor 15 mounted outside heater 3. As shown in FIG. 1, water pressure sensor 15 is located on a separate circuit than temperature sensor 50. It is electrically connected to spa controller 7, which is electrically connected to regulation relay 111.

Tub Temperature Sensor

Spa controller 7 also receives an input from tub temperature sensor 112. A user of spa 1 can set the desired temperature of the water inside tub 2 to a predetermined level from keypad 200. When the temperature of the water inside tub 2 reaches the predetermined level, spa controller 7 will remove the voltage to regulation relay 111, and power to heating element 5 will be interrupted.

Operation of Water Pressure Sensor

In normal operation, when water pressure sensor 15 reaches a specific level, the electromechanical switch of the sensor changes its state. This new switch state indicates that the water pressure inside heater 3 is strong enough to permit the heating process without the risk of dry fire. Likewise, in a fashion similar to that described for temperature sensor 50, when a lower end limit pressure limit is reached, such as about 1.5–2.0 psi, positive voltage is removed from regulation relay 111, and power to heating element 5 is interrupted.

However, there are major problems associated with water pressure sensors. For example, due to rust corrosion, these devices frequently experience obstruction of their switch mechanism either in the closed or open state. Another problem is related to the poor accuracy and the time drift of the pressure sensor adjustment mechanism. Also, water pressure sensors may have leaking diaphragms, which can lead to sensor failure. The above problems inevitably add to the overall expense of the system because they may lead to the replacement or calibration of water pressure sensor switch. Another problem with water pressure sensor 15 is that it will not protect the spa's components from a hot pipe condition, because it will not turn off heating element 5 so long as there is adequate pressure inside heater 3.

By reference to FIG. 1, a potential cause of a hot pipe condition could be found if slice valve 71 was closed and water pump 1A was on. Water pump 1A would try to pump water through heater 3, but closed slice valve 71 would block the flow. Meanwhile, heating element 5 would heat the water inside heater 3. If the circuit incorporating temperature sensor 50 failed, water pressure sensor 15 would not serve as a reliable back up in that it would sense that there is adequate pressure inside heater 3. Heating element 5 would continue to heat the water inside heater 3 and as the water became hotter, a hot pipe condition could result.

Water Flow Sensor

Another known solution to the dry fire problem is the installation of water flow sensor 16 into the heating pipe, as shown in FIG. 2. An advantage of the water flow sensor over the water pressure sensor is that it does protect the spa from a hot pipe condition because it will cause heating element 5 to be deactivated if there is inadequate flow through heater 3. However, like the water pressure sensor, water flow sensor 16 is prone to mechanical failure in either the open or close state. Moreover, water flow sensor switches are expensive (approximately $12 per switch) and relatively difficult to mount.

An additional major problem exists for both the water flow sensor switch and the water pressure sensor switch. Neither of these sensors directly addresses the overheating problems because each relies on an indirect method of determining whether or not the heating element is too hot. The water flow sensor switch only senses adequate water flow and the water pressure switch only senses adequate water pressure. Neither directly senses the temperature of heating element 5.

Microprocessor Utilization

It is known in the prior art that it is possible to substitute a microprocessor in place of the comparator circuit and control circuit, as shown in FIG. 3. Microprocessor 56A is programmed to serve the same function as comparator circuit 51A and control circuit 52A (FIG. 1). When an upper end limit temperature limit is reached, such as about 120 degrees Fahrenheit, microprocessor 56A is programmed to cause positive voltage to be removed from high temperature limit relay 53A, and power to heating element 5 is interrupted.

Infrared Radiation

The electromagnetic spectrum includes gamma rays, X-rays, ultraviolet, visible, infrared, microwaves, and radio waves. The difference between these different types of radiation is their wavelength and frequency. Wavelength increases and frequency decreases from gamma rays to radio waves. Infrared radiation lies between the visible and microwave portions of the electromagnetic spectrum. Thus infrared waves have wavelengths longer than visible and shorter than microwaves and have frequencies that are lower than visible and higher than microwaves.

The primary source of infrared radiation is heat or thermal energy. Any object that has a temperature above absolute zero (−459.67 degrees Fahrenheit or −273.15 degrees Celsius or 0 degrees Kelvin) radiates energy over a fairly broad spectrum. The warmer the object, the higher the frequency and intensity of the radiated energy.

Infrared sensors are known in the prior art and are used to sense the radiated energy to determine the temperature of the radiation source.

What is needed is a better device for preventing overheating conditions in a hot tub spa.

SUMMARY OF THE INVENTION

The present invention provides an overheating protection system for a spa and the spa's associated equipment. Elements include: a heating element for heating the spa's water, an infrared sensor for detecting the amount of infrared radiation emitted by the heating element, a heating element deactivation device electrically connected to the heating element and the infrared sensor, wherein the heating element deactivation device is for deactivating the heating element. In a preferred embodiment, the heating element deactivation device is an electric circuit comprising a comparator circuit and a control circuit.

DETAILED DESCRIPTION OF THE PREFERRED EMBODIMENT

Figure 1:
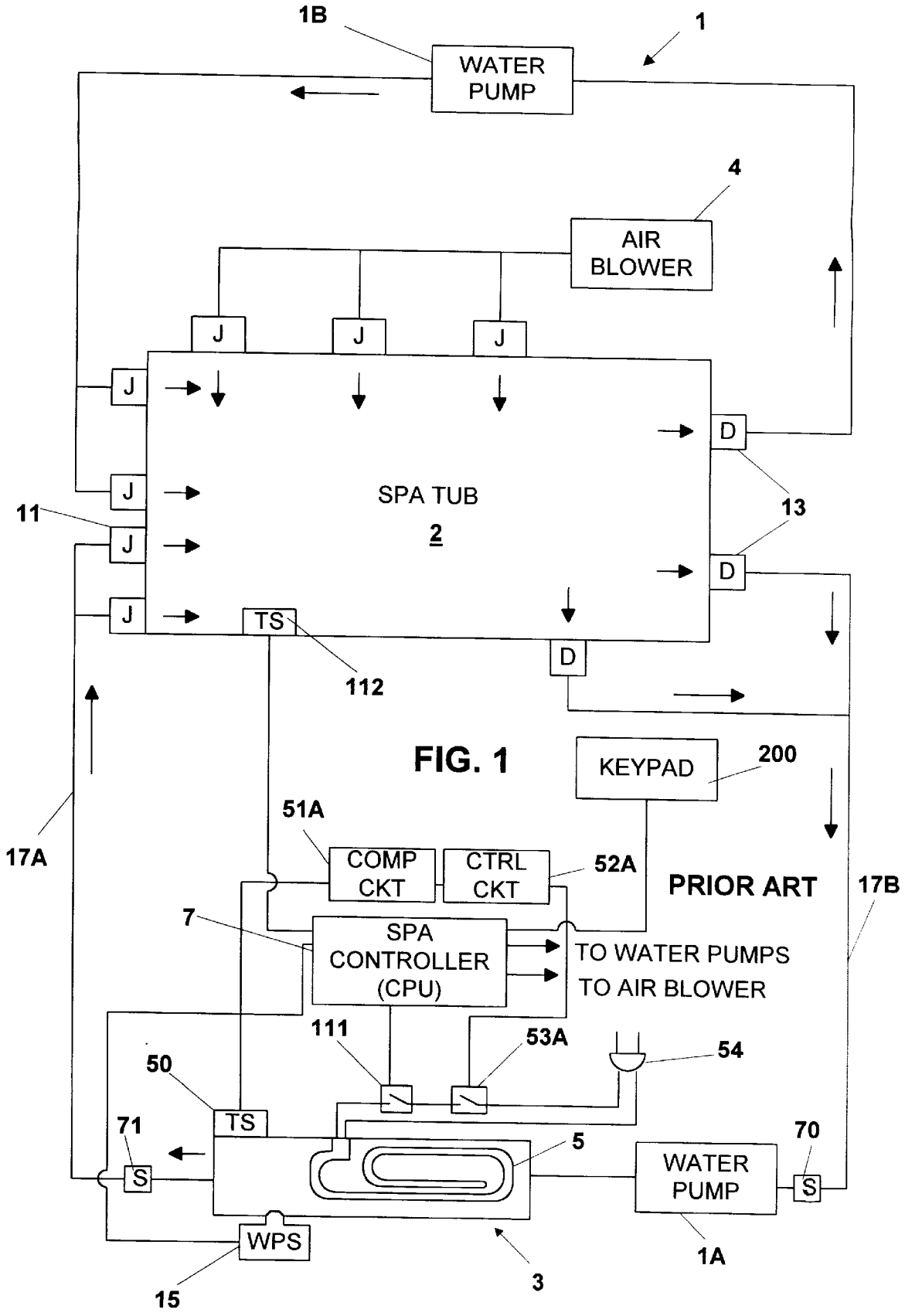
FIG. 1 shows a prior art hot tub spa utilizing a water pressure sensor.
Figure 2:
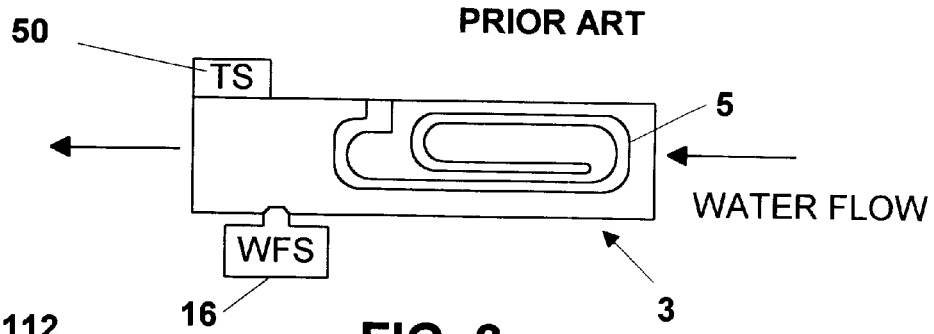
FIG. 2 shows a prior art heater utilizing a water flow sensor.
Figure 3:
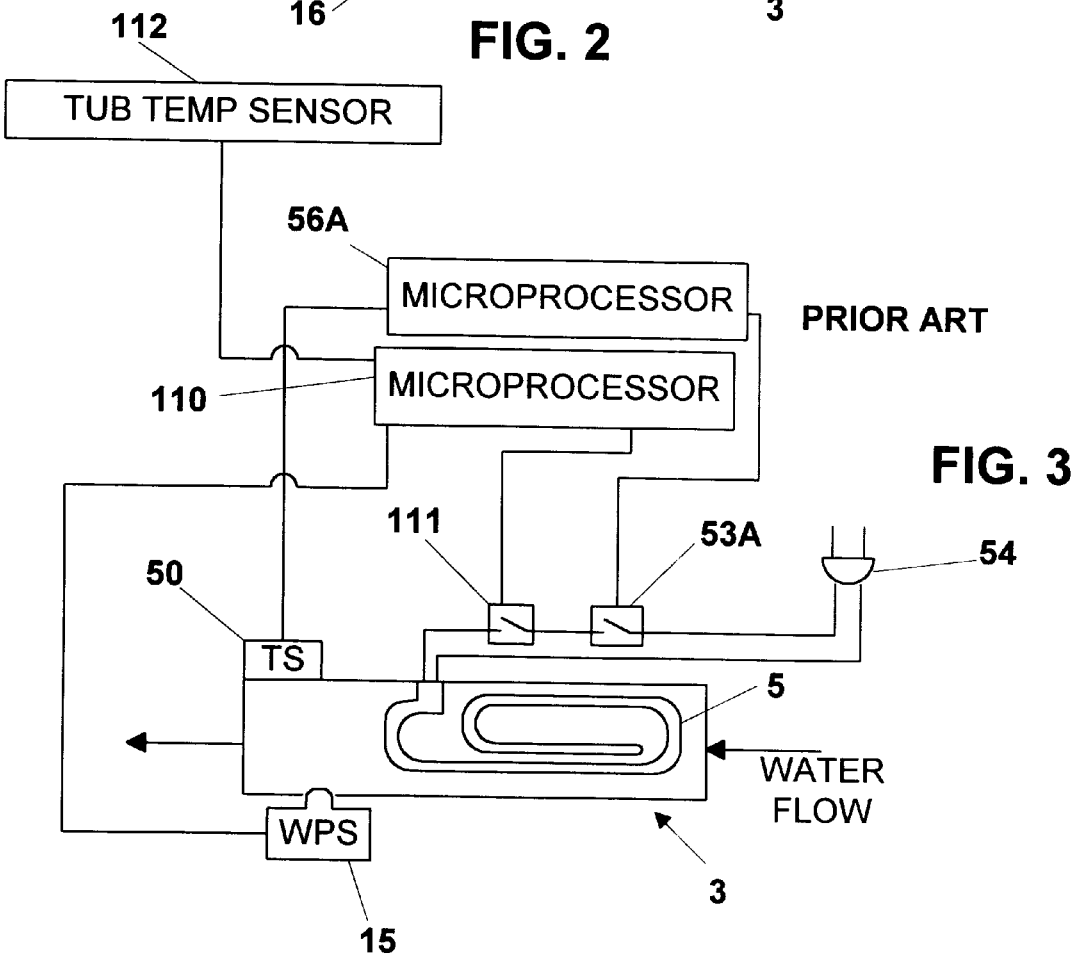
FIG. 3 shows a prior art utilization of a microprocessor.
Figure 4:
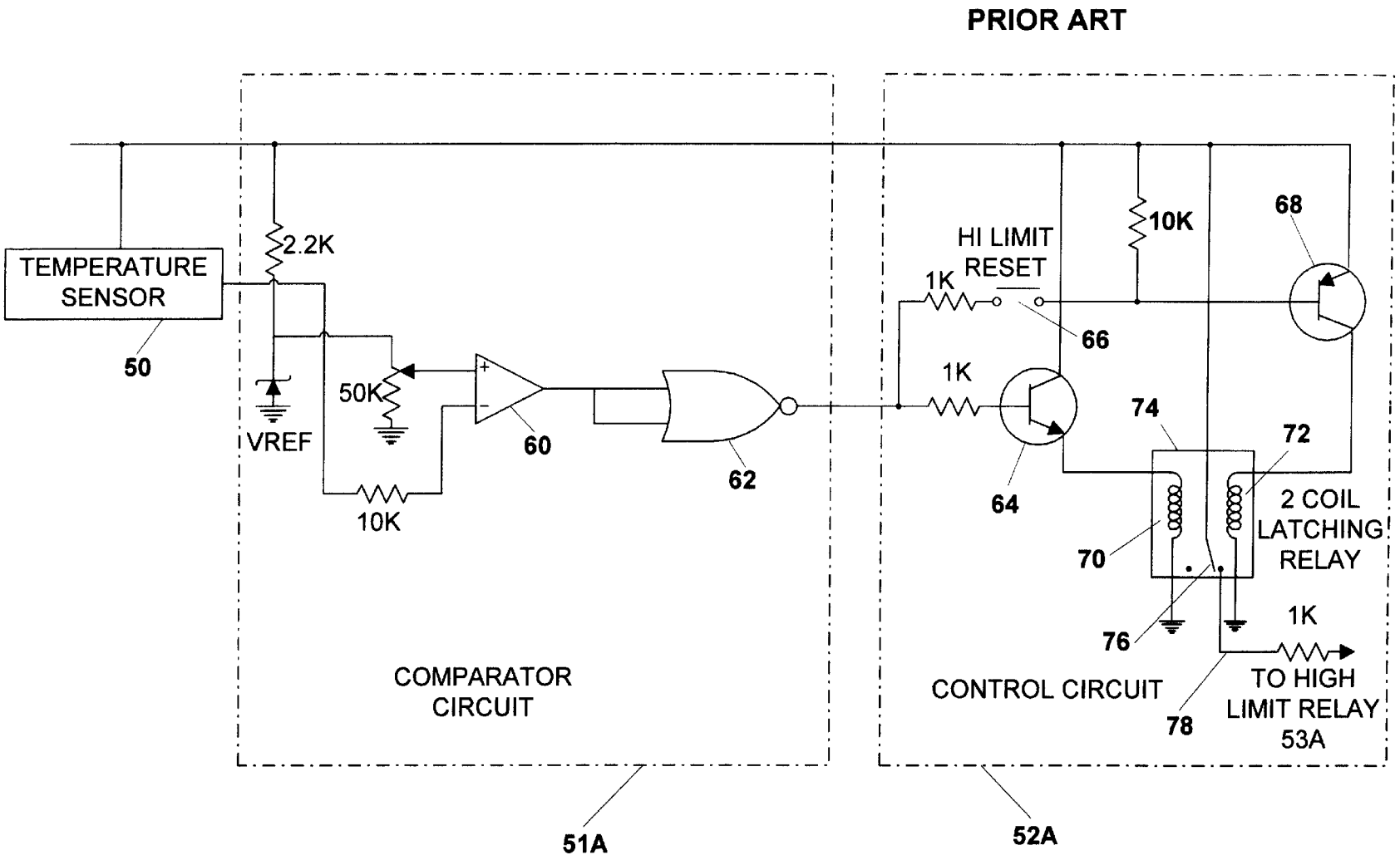
FIG. 4 shows a prior art circuit comprising a comparator circuit and a control circuit.
Figure 5:
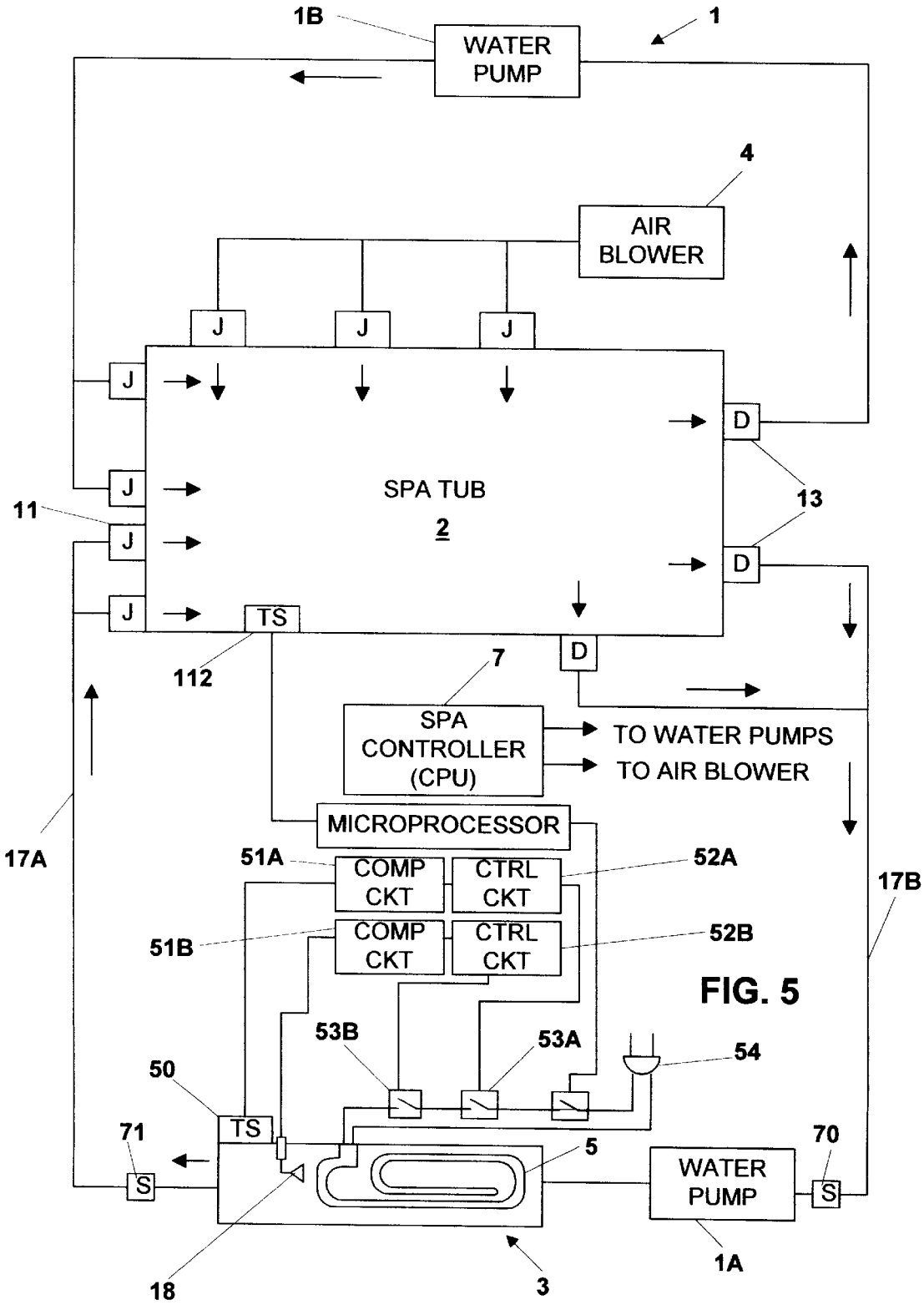
FIG. 5 shows a hot tub spa utilizing a preferred embodiment of the present invention.
Figure 6:
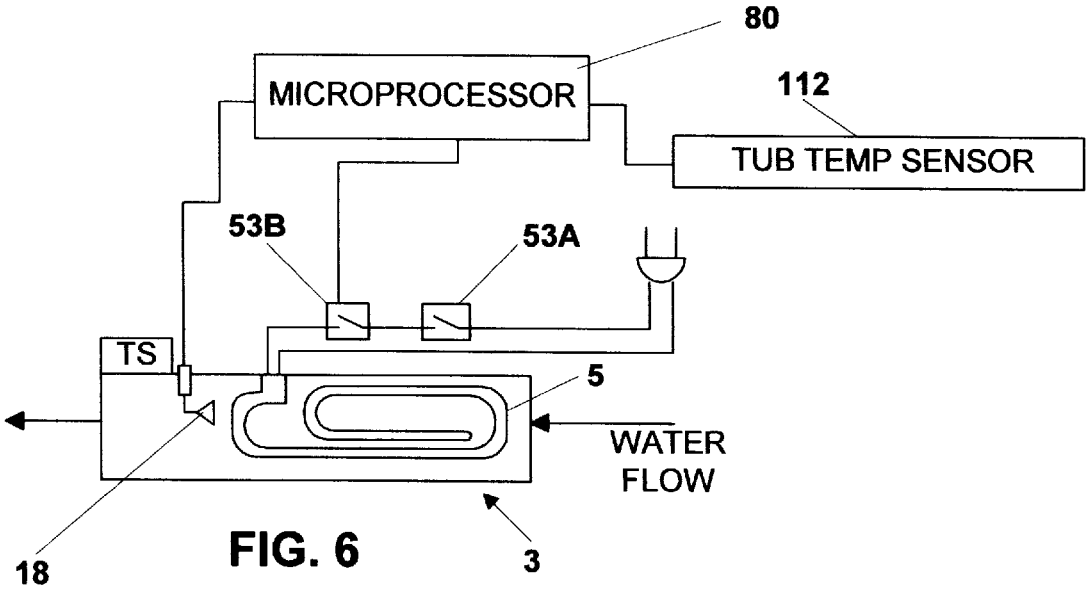
FIG. 6 shows another preferred embodiment of the present invention.
Figure 7:
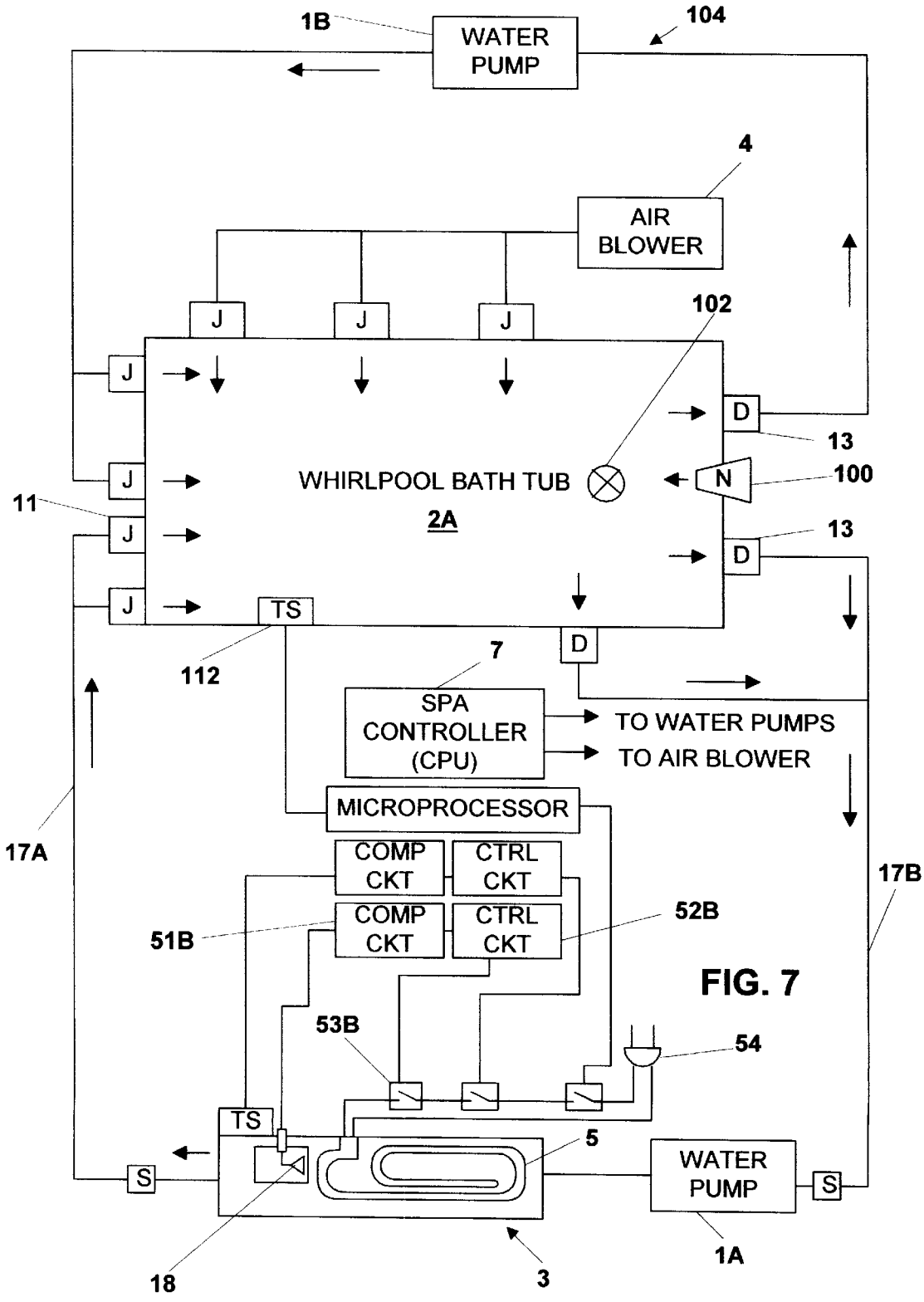
FIG. 7 shows another preferred embodiment of the present invention.

A detailed description of a preferred embodiment of the present invention is seen by reference to FIGS. 5–7.

In a preferred embodiment, infrared sensor 18 (FIG. 5) is a thermopile infrared temperature sensor model no. OTC-238, manufactured by OPTO TECH Corporation with offices in Taiwan, R.O.C. The OTC-238 thermopile sensor consists of a series of 44 thermoelements, forming a sensitive area of 0.5×0.5 $mm^2$. The sensor is hermetically sealed into a metal housing, with an optical filter. This filter allows measurements to be made in the spectral range above the 5

μm wavelength. In this preferred embodiment, infrared sensor 18 is further encapsulated in a sealed enclosure. The sealed enclosure prevents water from contacting the surface of the infrared sensor, yet is transparent to infrared radiation so that infrared radiation emitted by heating element 5 and the water flowing through heater 3 can be sensed by infrared sensor 18.

Infrared sensor 18 is mounted to heater 3. Infrared sensor 18 is part of an electrical circuit that includes comparator circuit 51B, control circuit 52B, and regulation relay 53B. Infrared sensor 18 is directly facing heating element 5 so that it can sense the infrared radiation emitted by heating element 5 as its temperature increases.

When infrared sensor 18 senses infrared radiation emitted by heating element 5 that is greater than a predetermined high limit level, control circuit 52B causes positive voltage to be removed from regulation relay 53B, and power to heating element 5 will be interrupted.

Protection Against a Hot Pipe Condition

The present invention provides safe, effective protection against a hot pipe condition. By reference to FIG. 5, a hot pipe condition can occur if there is a blockage of flow in either pipe 17A, slice valve 71 or in jets 11. Also, a hot pipe condition can occur if there is a failure of pump 1A. When water flow through heater 3 is significantly slowed or stopped, the temperature of heating element 5 will increase. When infrared sensor 18 senses infrared radiation emitted from heating element 5 that is too high, positive voltage will be removed from regulation relay 53B, and power to heating element 5 will be interrupted.

Protection Against a Dry Fire Condition

The present invention also provides protection against a dry fire condition. A dry fire can occur if heating element 5 is on and there is no water or very little water inside heater 5 to remove heat from heating element 5. A cause of a low or no water condition inside heater 3 could be blockage in pipe 17B or in drains 13 or a closed slice valve 70. Also, evaporation of water from spa tub 2 could cause a low water condition inside heater 3, leading to a dry fire. If there is no water or only a small amount of water inside heater 3, the temperature of heating element 5 will increase. When infrared sensor 18 senses infrared radiation emitted from heating element 5 that is too high, positive voltage will be removed from regulation relay 53B, and power to heating element 5 will be interrupted.

Whirlpool Bath Application

Although the above preferred embodiment discussed utilizing the present invention with spas that do not incorporate separate fill and drain devices, those of ordinary skill in the art will recognize that it is possible to utilize the present invention with spas that have separate fill and drain devices, commonly known as whirlpool baths.

A whirlpool bath is usually found indoors. Like a common bathtub, a whirlpool bath is usually filled just prior to use and drained soon after use. As shown in FIG. 7, tub 2A is filled with water prior to use via nozzle 100 and drained after use via tub drain 102. Once tub 2A is filled, whirlpool bath 104 operates in a fashion similar to that described for spa 1. Spa controller 7 is programmed to control the whirlpool bath's water pumps 1A and 1B and air blower 4. In normal operation, water is pumped by water pump 1A through heater 3 where it is heated by heating element 5. The heated water then leaves heater 3 and enters spa tub 2 through jets 11. Water leaves spa tub 2 through drains 13 and the cycle is repeated.

When infrared sensor 18 senses infrared radiation emitted by heating element 5 that is greater than a predetermined high limit level, control circuit 52B causes positive voltage to be removed from regulation relay 111, and power to heating element 5 is interrupted.

Although the above-preferred embodiments have been described with specificity, persons skilled in this art will recognize that many changes to the specific embodiments disclosed above could be made without departing from the spirit of the invention. FIG. 5 showed infrared sensor 18 as part of a circuit that included comparator circuit 51B, control circuit 52B, and high limit relay 111. Those of ordinary skill in the art will recognize that it is possible to substitute a microprocessor in place of comparator circuit 51B and control circuit 52B. FIG. 6 shows infrared sensor 18 as part of an electric circuit that includes microprocessor 80 in place of comparator circuit 51B and control circuit 52B. In this preferred embodiment, microprocessor 80 also receives input from tub temperature sensor 112. Microprocessor 80 controls regulation relay 53B. Also, although it was stated that in a preferred embodiment, infrared sensor 18 was an OTC-238 thermopile infrared sensor, those of ordinary skill in the art will recognize that it is possible to use a variety of other infrared sensing devices with the present invention. Therefore, the attached claims and their legal equivalents should determine the scope of the invention.

We claim:

1. An overheating protection system for a spa and the spa's associated equipment, comprising:

A. a heating element for heating the water contained in said spa,

B. an infrared sensor for detecting infrared radiation emitted by said heating element, wherein said infrared sensor is configured to generate a sensor output signal corresponding to said detected infrared radiation, and C. a heating element deactivation device in communication with said heating element and said infrared sensor, wherein said heating element deactivation device is configured to deactivate said heating element in response to said sensor output signal.

2. An overheating protection system as in claim 1, wherein said heating element deactivation device is an electrical circuit comprising:

A. a comparator circuit, and

B. a control circuit.

3. An overheating protection system as in claim 1, wherein said heating element deactivation device is a microprocessor programmed to deactivate said heating element if said infrared sensor detects infrared radiation greater than predetermined high limit value.

4. The overheating protection system as in claim 1, wherein said deactivation of said heating element occurs when the emitted infrared radiation of said heating element reaches a predetermined level.

5. The overheating protection system as in claim 1, wherein the spa is a whirlpool bath comprising separate fill and drain devices.

6. The overheating protection system as in claim 1, wherein said infrared sensor is an OTC-238 thermopile infrared sensor.

7. An overheating protection system for a spa and the spa's associated equipment, comprising:

A. a heating means for heating the water contained in said spa,

B. an infrared sensor for detecting infrared radiation emitted by said heating means, wherein said infrared sensor is configured to generate a sensor output signal corresponding to said detected infrared radiation, and C. a heating element deactivation means in communication with said heating means and said infrared sensor, wherein said heating element deactivation means is configured to deactivate said heating means in response to said sensor output signal.

8. An overheating protection system as in claim 7, wherein said heating element deactivation means is an electrical circuit comprising:

A. a comparator circuit, and

B. a control circuit.

9. An overheating protection system as in claim 7, wherein said heating element deactivation means is a microprocessor programmed to deactivate said heating element if said infrared sensor detects infrared radiation greater than a predetermined high limit value.

10. The overheating protection system as in claim 7, wherein said deactivation of said heating means occurs when the emitted infrared radiation of said heating means reaches an unsafe level.

11. The overheating protection system as in claim 7, wherein the spa is a whirlpool bath comprising separate fill and drain devices.

12. The overheating protection system as in claim 7, wherein said infrared sensor is an OTC-238 thermopile infrared sensor.

* * * * *